US007942164B2

(12) United States Patent
Hsiao

(10) Patent No.: US 7,942,164 B2
(45) Date of Patent: May 17, 2011

(54) DUAL-PURPOSE GAS STOVE SWITCH

(76) Inventor: Chi-Chen Hsiao, Chia Yi (TW)

( * ) Notice: Subject to any disclaimer, the term of this patent is extended or adjusted under 35 U.S.C. 154(b) by 680 days.

(21) Appl. No.: 12/050,322

(22) Filed: Mar. 18, 2008

(65) Prior Publication Data

US 2009/0235998 A1 Sep. 24, 2009

(51) Int. Cl.
*F16K 11/083* (2006.01)

(52) U.S. Cl. ..... 137/625.47

(58) Field of Classification Search ..... 137/625.47, 137/887

See application file for complete search history.

(56) References Cited

U.S. PATENT DOCUMENTS

| | | | | | |
|---|---|---|---|---|---|
| 1,775,980 | A * | 9/1930 | Walbridge | 126/39 J |
| 3,616,998 | A * | 11/1971 | Schneider | 236/99 R |
| 3,800,830 | A * | 4/1974 | Etter | 137/625.41 |
| 5,094,259 | A * | 3/1992 | Hsu | 137/66 |
| 5,277,221 | A * | 1/1994 | Amaya | 137/454.6 |
| 6,520,481 | B2 * | 2/2003 | Harneit | 251/207 |
| 6,886,581 | B2 * | 5/2005 | Harniet | 137/66 |

FOREIGN PATENT DOCUMENTS

| | | |
|---|---|---|
| TW | 271229 | 2/1996 |
| TW | 316659 | 9/1997 |
| TW | 327950 | 3/1998 |
| TW | 357875 | 5/1999 |
| TW | M289839 | 4/2006 |
| TW | M314834 | 7/2007 |

* cited by examiner

*Primary Examiner* — John Fox
(74) *Attorney, Agent, or Firm* — Stites & Harbison PLLC; Marvin Petry

(57) ABSTRACT

A dual-purpose gas stove switch includes a valve body and a valve seat. The valve body includes an inlet passageway, an interior passageway, a nozzle having a mouth, a compensation nozzle, and a compensation passageway in communication with the compensation nozzle. A valve core is received in a chamber formed by the valve body and the valve seat. The valve core includes a blind hole in communication with the mouth via the interior passageway. The valve core includes four holes and a compensation hole. The valve core is rotatable to make the four holes to be in selective communication with the inlet passageway. The compensation hole can be in communication with the compensation passageway and the compensation nozzle. Thus, the switch can be selectively utilized with liquefied petroleum gas or natural gas.

3 Claims, 4 Drawing Sheets

DUAL-PURPOSE GAS STOVE SWITCH

BACKGROUND OF THE INVENTION

The present invention relates to a dual-purpose gas stove switch and, more particularly, to a dual-purpose gas stove switch for selective use with liquefied petroleum gas or natural gas.

Due to the difference of the fuels, there are two types of gas stoves for use with liquefied petroleum gas (LPG) or natural gas. Due to gas pressure difference between liquefied petroleum gas and natural gas, the switches and nozzles for LPG gas stoves are different from those for natural gas stoves. Specifically, the gas pressure of natural gas is lower than that of LPG such that the diameters of the gas passageways in the switches and nozzles of natural gas stoves are larger than the diameters of the gas passageways in the switches and nozzles of LPG gas stoves, resulting in problems to the users in purchase of the gas stoves and to the manufacturers and distributors in inventory and maintenance.

To solve these problems, dual-purpose gas stove switches have been proposed. Taiwan Patent Application No. 084210422 and Taiwan Patent of Addition No. 08421042-A01 disclose a gas stove switch including an inlet tube seat and a plurality of nozzles. An adjusting valve device mounted between each nozzle and the inlet tube seat. Each adjusting valve device includes a valve seat and a stem, wherein the valve seat is in communication with the inlet tube seat and one of the nozzles, and the stem is mounted in a center of the valve seat and includes a larger outlet and a smaller outlet both of which are in communication with an inlet. The stem can be turned to align the larger outlet with the nozzle for use with natural gas. On the other hand, the stem can be turned to align the smaller outlet with the nozzle for use with liquefied petroleum gas.

Taiwan Patent of Addition No. 084210422-A02, Taiwan Patent Application No. 087203024 and Taiwan Patent Application No. 095223271 disclose an auxiliary passageway between each nozzle and the inlet tube seat. An adjusting rod is mounted in the auxiliary passageway and can be turned to close the auxiliary passageway for use with liquefied petroleum gas. On the other hand, the adjusting rod can be turned to open the auxiliary passageway for use with natural gas.

Taiwan Patent Application No. 094219428 discloses a valve body including an inlet, an outlet, and an assembling hole between the inlet and the outlet. A throttle is pivotably mounted in the assembling hole and includes a passageway. A valve cap is mounted to an outer end of the assembling hole and includes an annular track having a groove. A rod is pivotably extended through the valve cap and connected to the throttle by two engaging portions. A cam is mounted to the rod and biased by a spring such that a lobe of the cam is restrained in the groove. The passageway of the throttle is in a closed position when the cam is in a disengaged position corresponding to the two engaging portions. The valve cap includes an axial rack in the track. When the cam is driven by the rod such that the lobe disengages from the groove and engages with the rack, the lobe can resiliently bear against the rack at any position to allow synchronous reciprocating axial adjusting movement of a switch for natural gas as well as gas flow control thereof. Furthermore, the valve cap includes an adjusting hole corresponding to the position of the rack. A stop can be locked in the adjusting hole to restrain rotation of the lobe on the rack for use with a switch for liquefied petroleum gas as well as flow control thereof. However, the stop can not be utilized to operate with the switch for natural gas and, thus, can not control the gas flow.

The above-mentioned gas stove switches fail to provide modification to the nozzles. Improvement of the gas stove switches in this regard is still possible.

BRIEF SUMMARY OF THE INVENTION

A dual-purpose gas stove switch in accordance with the present invention includes a valve body and a valve seat. The valve body includes an inlet passageway, an interior passageway, a nozzle having a mouth, a compensation nozzle adjacent to the nozzle, and a compensation passageway in communication with the compensation nozzle. A valve core is received in a chamber formed by the valve body and the valve seat. The valve core includes a blind hole in an end thereof. A rod is coupled with the other end of the valve core. The blind hole is in communication with the mouth via the interior passageway. The valve core includes a first hole, a second hole, a third hole, a fourth hole, and a compensation hole. The first, second, third, and fourth holes are located on a common circumference. The valve core is rotatable to make the first, second, third, and fourth holes to be in selective communication with the inlet passageway. When the first or second hole of the valve core is in communication with the inlet passageway of the valve body through turning of the rod, the dual-purpose gas stove switch can be utilized with liquefied petroleum gas. When the third hole, fourth hole, and the compensation hole are in communication with the inlet passageway through turning of the rod, the dual-purpose gas stove switch can be utilized with natural gas.

Other objects, advantages and novel features of this invention will become more apparent from the following detailed description when taken in conjunction with the accompanying drawings.

DETAILED DESCRIPTION OF THE INVENTION

Figure 1:
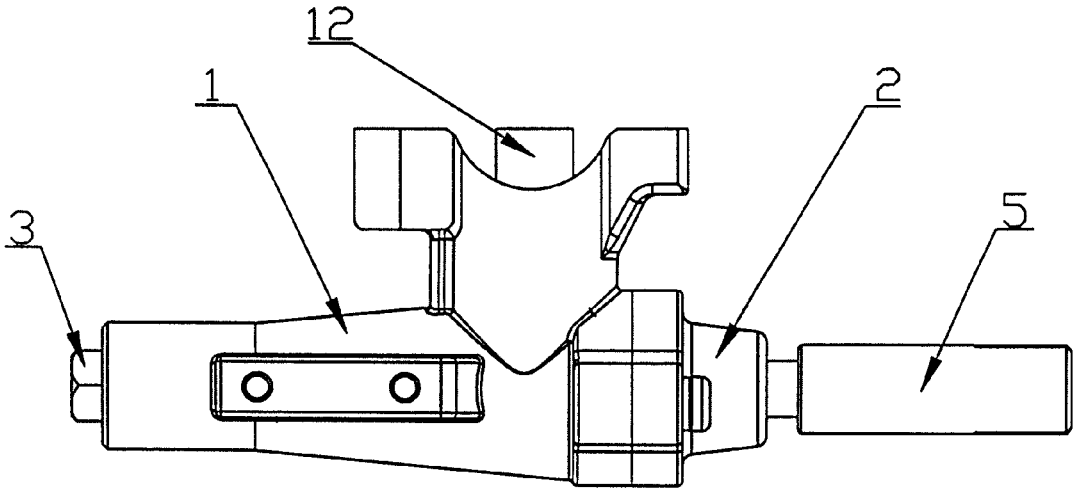
FIG. 1 shows a diagrammatic perspective view of a dual-purpose gas stove switch in accordance with the present invention.
Figure 2:
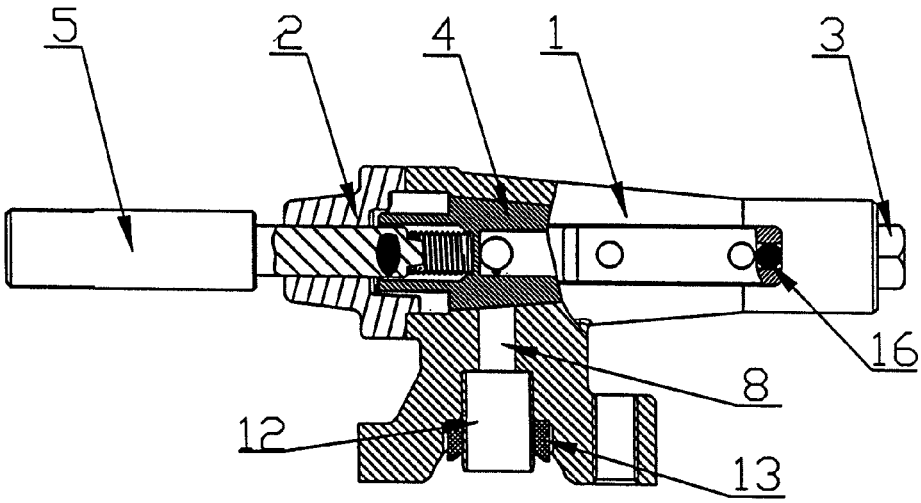
FIG. 2 shows a partly-sectioned perspective view of the gas stove switch of FIG. 1.
Figure 3:
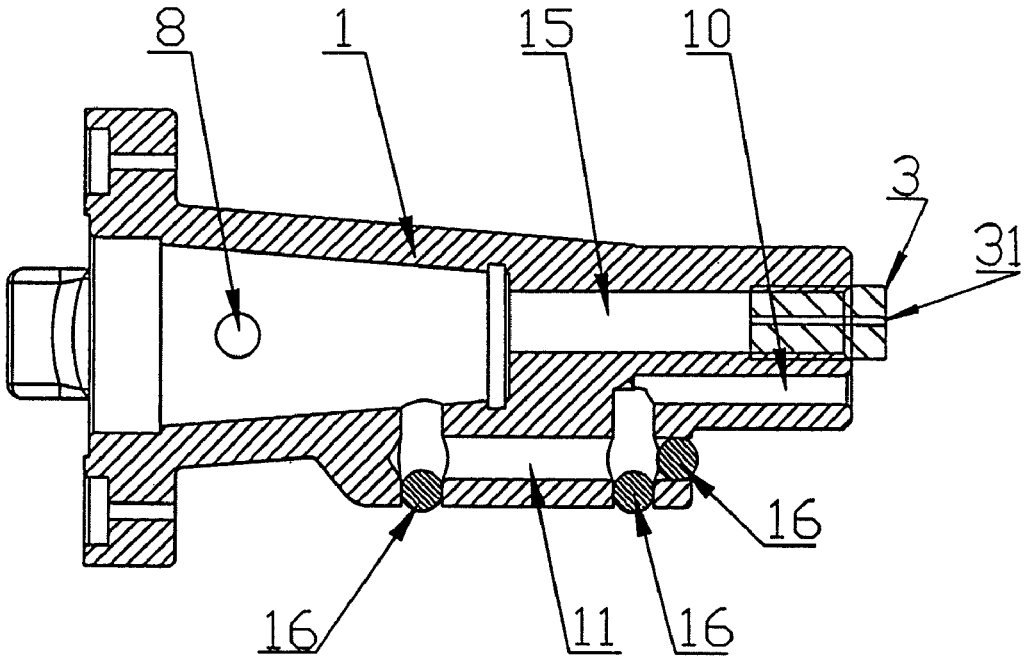
FIG. 3 shows a cross sectional view of a valve body of the gas stove switch of FIG. 1.
Figure 4:
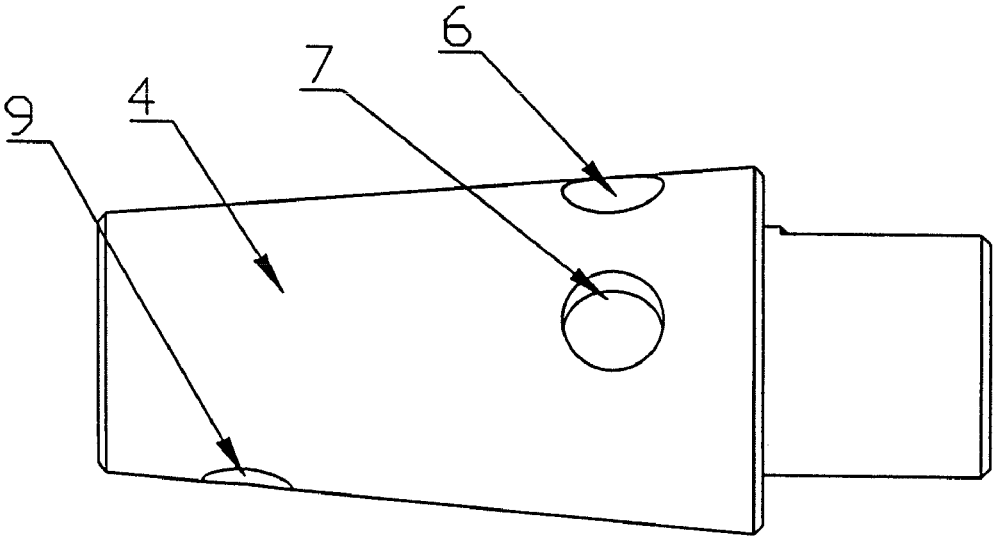
FIG. 4 shows a perspective view of a valve core of the gas stove switch of FIG. 1.
Figure 5:
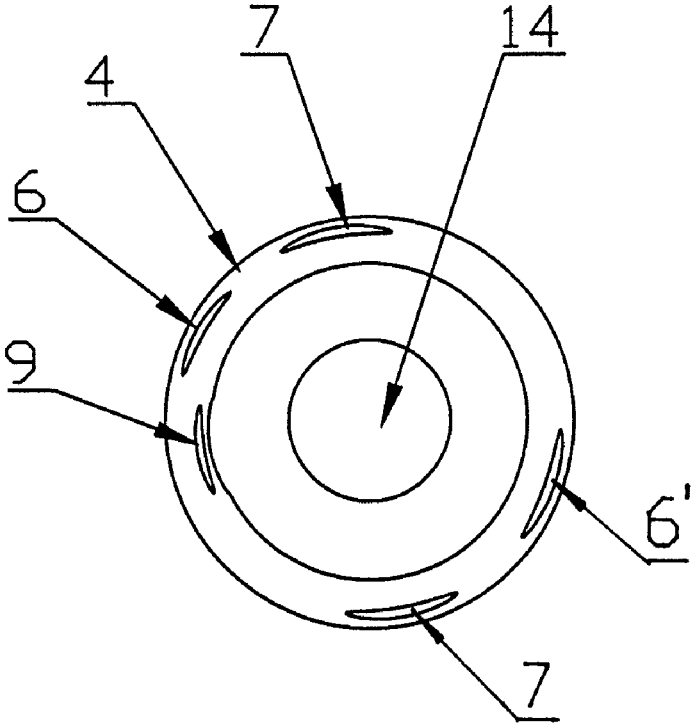
FIG. 5 shows an end view of the valve core of FIG. 4.
Figure 6:
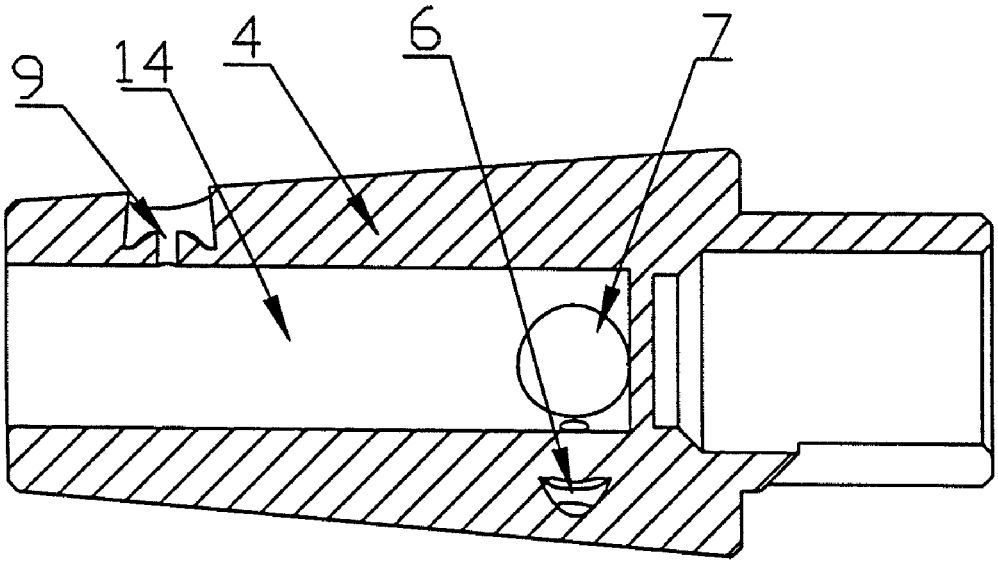
FIG. 6 shows a cross sectional view of the valve core of FIG. 4.

With reference to FIGS. 1-6, a dual-purpose gas stove switch in accordance with the present invention includes a valve body 1 and a valve seat 2. The valve body 1 includes an inlet passageway 8, an interior passageway 15, a nozzle 3 having a mouth 31, a compensation nozzle 10 adjacent to the nozzle 3, and a compensation passageway 11 in communication with the compensation nozzle 10. Openings resulting from processing for forming the compensation passageway 11 are sealed by balls 16 to prevent leakage of gas.

A valve core 4 is mounted in a chamber formed by the valve body 1 and the valve seat 2. A blind hole 14 is formed in an end of the valve core 4 and is in communication with the mouth 31 via the interior passageway 15. A rod 5 is coupled with the other end of the valve core 4. The valve core 4 further includes a first hole 7', a second hole 6', a third hole 7, a fourth hole 6, and a compensation hole 9. The first, second, third, and fourth holes 7', 6', 7, 6 are located on a common circumference. The first hole 7' and the third hole 7 are diametrically opposed along an axis of the valve core 4 and have the same diameter. The second hole 6' and the fourth hole 6 are diametrically opposed along the axis of the valve core 4 and have the same diameter. However, the diameter of the first and third holes 7' and 7 is larger than that of the second and fourth holes 6' and 6.

The inlet passageway 8 of the valve body 1 is in selective communication with the first, second, third, and fourth holes 7', 6', 7, and 6. The inlet passageway 8 includes a coupling end 12 sealed by a rubber washer 13. The angle between the first hole 7' and the second hole 6' (or between the third hole 7 and the fourth hole 6) is determined according to the diameter of the inlet passageway 8. Particularly, when the valve core 4 is turned to an angular position, the first hole 7' (or the third hole 7) for big fire is partially communicated whereas the second hole 6' (or the fourth hole 6) for small fire is partially communicated. Thus, the burning flame can be adjusted from big fire to small fire in a continuous manner. When the valve core 4 is turned to make the third hole 7 in communication with the inlet passageway 8, the compensation hole 9 is in communication with the compensation passageway 11 and the compensation nozzle 10 for use with natural gas.

Figure 7:
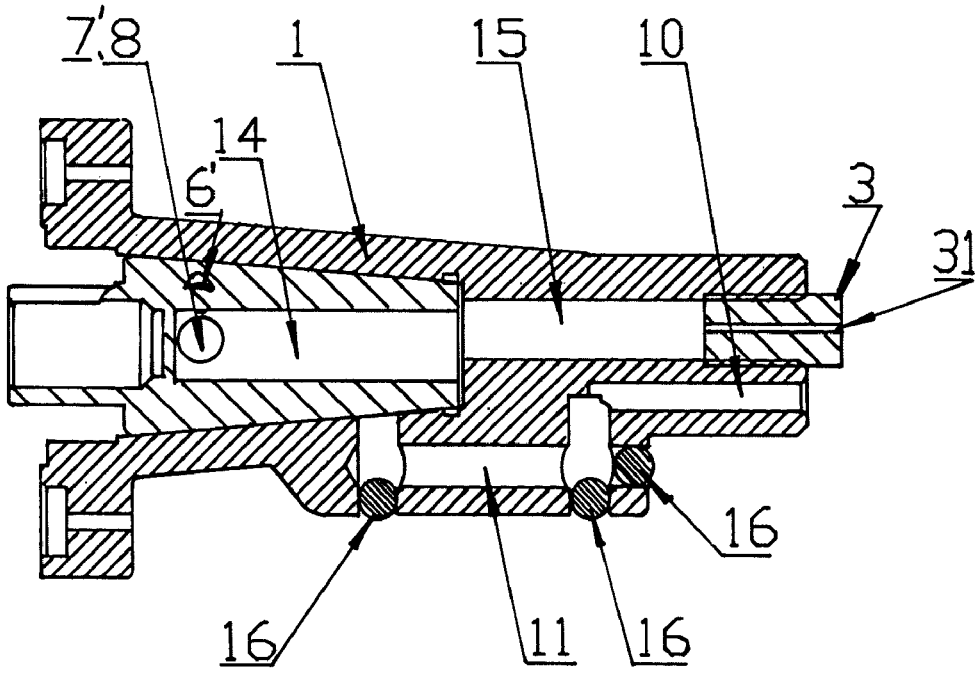
FIG. 7 is a cross sectional view illustrating use the gas stove switch of FIG. 1 with liquefied petroleum gas.

With reference to FIG. 7, when using the dual-purpose gas stove switch of the present invention with liquefied petroleum gas, the rod 5 is turned to make the first hole 7' or the second hole 6' of the valve core 4 in communication with the inlet passageway 8, gas can only be supplied by the nozzle 3 for burning purposes.

Figure 8:
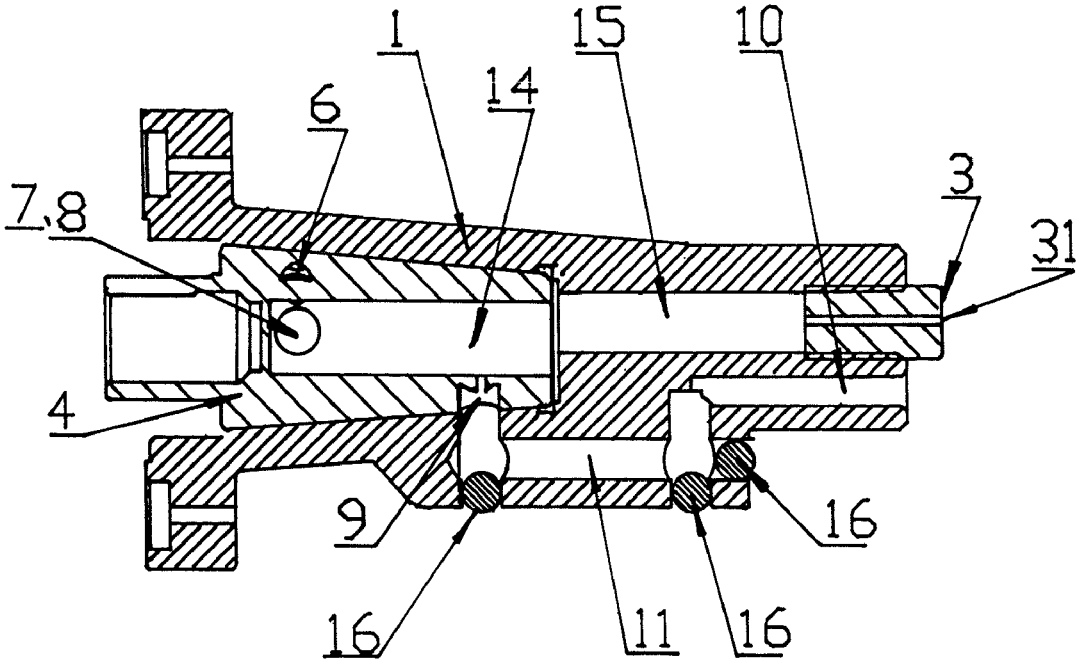
FIG. 8 is a cross sectional view illustrating use of the gas stove switch of FIG. 1 with natural gas.

With reference to FIG. 8, when using the dual-purpose gas stove switch of the present invention with natural gas, the rod 5 is turned to make the third hole 7 or the fourth hole 6 of the valve core 4 in communication with the inlet passageway 8. The compensation hole 9 is in communication with the compensation passageway 11 and the compensation nozzle 10 of the valve body 11. At this time, gas can be supplied via the nozzle 3 and the compensation nozzle 10 adjacent to the nozzle 3 for burning purposes.

While the principles of this invention have been disclosed in connection with the specific embodiment, it should be understood by those skilled in the art that these descriptions are not intended to limit the scope of the invention, and that any modification and variation without departing the spirit of the invention is intended to be covered by the scope of this invention defined only by the appended claims.

The invention claimed is:

1. A dual-purpose gas stove switch comprising:

a valve body including an inlet passageway, an interior passageway, a nozzle having a mouth, a compensation nozzle adjacent to the nozzle, and a compensation passageway in communication with the compensation nozzle;

a valve seat; and a valve core received in a chamber formed by the valve body and the valve seat, with the valve core including a blind hole in an end thereof, with the blind hole being in communication with the mouth via the interior passageway, with the valve core including a first hole, a second hole, a third hole, a fourth hole, and a compensation hole, with the first, second, third, and fourth holes being located on a common circumference, with the valve core being rotatable to make the first, second, third, and fourth holes to be in selective communication with the inlet passageway, wherein when the third hole is in communication with the inlet passageway, the compensation hole is in communication with the compensation passageway and the compensation nozzle.

2. The dual-purpose gas stove switch as claimed in claim 1, further including a rod coupled to another end of the valve core.

3. The dual-purpose gas stove switch as claimed in claim 1, with the first and third holes being diametrically opposed along an axis of the valve core and having the same diameter, with the second and fourth holes being diametrically opposed along the axis of the valve core and having the same diameter, and with the diameter of the first and second holes being larger than the diameter of the second and fourth holes.

* * * * *